US005967215A

United States Patent [19]

Needham et al.

[11] Patent Number: 5,967,215

[45] Date of Patent: Oct. 19, 1999

[54] ONE-AND TWO-WAY PET SCREEN DOOR KIT

[76] Inventors: John M. Needham; Maryann M. Needham, both of 318 Viewpark Cir., San Jose, Calif. 95136

[21] Appl. No.: 09/132,909

[22] Filed: Aug. 12, 1998

[51] Int. Cl.[6] ..... E06B 7/28

[52] U.S. Cl. ..... 160/180; 49/168

[58] Field of Search ..... 160/180, 237, 160/10; 49/168, 169, 170, 171

[56] References Cited

U.S. PATENT DOCUMENTS

| | | |
|---|---|---|
| 3,811,224 | 5/1974 | Garrison . |
| 3,985,174 | 10/1976 | Bricker . |
| 4,053,007 | 10/1977 | Griffth . |
| 4,334,573 | 6/1982 | Hackman et al. . |
| 4,384,376 | 5/1983 | Shrode . |
| 4,480,407 | 11/1984 | Needham et al. . |
| 4,603,724 | 8/1986 | Borwick . |
| 5,269,097 | 12/1993 | Davlantes . |
| 5,535,804 | 7/1996 | Guest . |
| 5,701,813 | 12/1997 | Smith . |
| 5,730,196 | 3/1998 | Frament . |

FOREIGN PATENT DOCUMENTS

| | | |
|---|---|---|
| 2101182 | 1/1983 | United Kingdom . |
| 2236135 | 3/1991 | United Kingdom . |

*Primary Examiner*—Blair M. Johnson
*Attorney, Agent, or Firm*—Richard C. Litman

[57] ABSTRACT

A one- and two-way pet screen door kit is provided for installation in an existing screen door or window screen to allow pets to pass through in one or both directions. The door is made up of a rectangular metal frame having a pair of magnetic latches located at the base of the door. The door is supported by a pair of symmetrically and horizontally disposed hinge members located near the top sides of the frame and strengthened at its center by a horizontal luminous crossbar. In the lower portion of the pet door, a pair of slide locks is positioned to lock each side to keep the pet either outside or inside. A pair of swivel locks are located on both sides of the door with locking ears on both inside and outside surfaces for one-way traffic. The magnetic latches maintain the pet door in a closed position when the pet is not using the door, and do not present a hindrance for the pet in using the door. Besides the factory made framed pet door, the installation kit contains a pair of side bars, a double-sided spline roller, a length of spline, a single edged razor blade, a fluorescent crossbar, fasteners, and instructions. An optional portable pet ramp is provided for elevated screen doors inaccessable by diminutive pets.

11 Claims, 3 Drawing Sheets

ONE-AND TWO-WAY PET SCREEN DOOR KIT

BACKGROUND OF THE INVENTION

1. Field of the Invention

The present invention relates generally to pet doors. More specifically, the invention is a pet door kit for installation of a durable and safe one- and two-way prefabricated screen door that can be installed in an existing screen door or window-screen by a do-it yourself owner to allow pets to pass through. The prefabricated door consists of a rectangular metal frame with a fiberglass screen having a pair of magnetic latches located near the base corners of the frame. The door can be structurally supported by an optional horizontal crossbar coated with a fluorescent tape. A pair of symmetrically and horizontally disposed hinge members located near the top sides of the frame enable swinging of the pet door. In the lower portion of the pet door, a pair of slide locks with finger pulls is positioned to lock each side to keep the pet either outside or inside. A pair of swivel locks are located on both sides of the door with locking ears on both inside and outside surfaces for monitoring one-way traffic. The magnetic latches maintain the two-way door in a closed position when the pet is not using the door, and do not present a hindrance for the pet to use the door. Besides the factory made framed pet door, the installation kit contains a double-bladed spline roller, a length of spline, a single edged razor blade, fasteners, the crossbar, and instructions. An optional pet ramp is provided for elevated screen doors for diminutive pets.

2. Description of the Related Art

The related art of interest describes various pet doors. However, there is a need for a pet door kit which provides the necessary tools to install the pet door in a screened window or door, and various locking alternatives, such as to prevent one-way or two-way use. The related art will be discussed in the order of perceived relevance to the present invention.

U.S. Pat. No. 4,053,007 issued on Oct. 11, 1977, to Raymond E. Griffth describes an animal access door kit for either a corner or central location adjacent the lower edge of a screen door. For a corner installation, a horizontal rail traversing the width of the screen door is attached. A short vertical rail is attached to the lower door rail and the horizontal rail to define the pet door which has its own square frame. The cut screen edges are tucked into flanged channels of the outer and inner frames and sealed with a resilient seal strip. A horizontal rod traversing the pet door stiles serves to permit swinging of the pet door. The pet door kit is distinguishable for its horizontal rail traversing the main door frame, a horizontal swing rod and the lack of closures.

U.S. Pat. No. 4,603,724 issued on Aug. 5, 1986, to Michael J. Borwick describes a plastic pet door for a screen door. The rectangular door frame and the outer fixed frame clamp onto the screening material with male and female members having a rectangular cross-section. In a second embodiment, the door frame has protruding hinge portions at the top region and embedded magnets in the bottom region. A first embodiment shows a conventional pivotal lever on the outside of the bottom door frame which locks with an offset arm on the outer fixed frame. The plastic pet door is distinguishable for the difference in anchoring the screening in two-piece frame members.

U.K. Patent Application No. 2,101,182 A published on Jan. 12, 1983, for James K. Dunlop et al. describes a cat door with a two-part locking mechanism which permits in a first condition to move the door flap only inward. A second condition permits the door flap to move in either direction. A third condition permits the door flap to move only outward. A fourth condition prohibits movement of the door flap. Two interlocking tabs shaped either triangularly or elliptically are positioned on both sides of the lower rail of the outer pet door frame. The locking mechanism is distinguishable for its particular interlocking structure. U.S. Pat. No. 5,535,804 issued on Jul. 16, 1996, to Robert J. Guest describes a pet door kit made of two identical integral moldings of rectangular frame sides and door sides which are assembled onto a mesh screen panel by pins of one molding interfitting bores of the other molding before cutting the screen around the door except for the top portion. The frame moldings have two flexible webs acting as hinges on the top portion of the door. A sliding latch and enclosed magnets are provided at the bottom. The pet door kit is distinguishable for its non-metallic composition and two-piece molding construction.

U.S. Pat. No. 5,269,097 issued on Dec. 14, 1993, to George N. Davlantes describes a pet access door modular unit consisting of five rectangular frames, wherein the exterior frames can carry an access door. Two pairs of magnets are located on the lower portions of the pet access door. The modular unit is distinguishable for its multiple frames.

U.S. Pat. No. 3,797,554 issued on Mar. 19, 1974, to Frances H. Johnson describes a solid pet door structure wherein the door swings from a cane shaped hinge structure on the top portion of the frame. The pet door is distinguishable for its dissimilar hinge structure and its solid composition.

U.S. Pat. No. 4,480,407 issued on Nov. 6, 1984, to Robert J. Needham et al. describes a top-hinged swinging trapeziform door for a door, wall or window lined with either one or two pairs of coacting plastic magnet strips along the vertical sides or three sides around the door. The door is distinguishable by its unique configuration with plastic magnet strips. U.S. Pat. No. 3,985,174 issued on Oct. 12, 1976, to Charles O. Bricker describes a pet door installed in a corner of a window or screen consisting of a screen frame member having a frame track in which a spline cord can hold the edge of a cut off screen portion together with first and second outer members which are coupled to the center screen frame member. One of the outer frame members having a hinged center portion for allowing passage. The pet door is distinguishable for having three rectangular mounting frames and a solid top-hung swinging door.

U.S. Pat. No. 4,334,573 issued on Jun. 15, 1982, to La Vona R. Hackman et al. describes a swinging pet access door kit for installation in a corner of a screen door. A pair of L-shaped frame members are secured on either side of the screen in a corner of the screen door. The enclosed screen portion is cut along the sides and bottom. A weight member is attached to the lower edge. The pet door is distinguishable for its unframed swinging door.

U.S. Pat. No. 5,701,813 issued on Dec. 30, 1997, to John M. Smith describes a solid vinyl or rubber pet door for a screen door or window by framing the pet door in a corner with a horizontal rail and a vertical stile connected to each other and to the main door or window corner by three brackets. The framing rail and stile have rectangular hollow cross-sections with a flange for accepting the spline to trap the screen edges. The pet door is distinguishable for its requirement of a flexible solid door and the lack of any closures.

U.K. Patent Application No. 2,236,135 A published on Mar. 27, 1991, for Christopher P. Kirk describes an injection molded plastic cat door installed in a wall or solid door. The solid swinging pet: door is lockable by a locking unit in an extensive compartment: below the pet door comprising double discs having parallel straight edges on a spindle. The locking mechanism is distinguishable for its unique disc structure and placement in solid walls.

None of the above inventions and patents, taken either singularly or in combination, is seen to describe the instant invention as claimed. Thus, a one-way or two-way pet screen door solving the aforementioned problems is desired.

SUMMARY OF THE INVENTION

A one- and two-way pet screen door kit is provided for a do-it-yourself installation in an existing screen door or window screen to allow pets to pass through in one or both directions. The door consists of a rectangular metal frame having a pair of magnetic latches located at the base of the door. The door is supported by a pair of symmetrically and horizontally disposed hinge members located near the top sides of the frame and strengthened at its center by an optional horizontal fluorescent: crossbar. In the lower portion of the pet door, a pair of slide locks is positioned to lock each side to keep the pet either outside or inside. A pair of swivel locks are located on both sides of the door with locking ears on both inside and outside surfaces for one-way traffic. The magnetic latches maintain the pet door in a closed position when the pet is not using the door, and do not present a hindrance for the pet in using the door. Besides the factory made framed pet door, the installation kit contains a spline roller with two roller discs, a length of spline, a single edged razor blade, fasteners, a roll of fluorescent tape, a crossbar, and instructions. An optional portable pet ramp is provided for screen doors elevated over steps for access by diminutive pets.

Accordingly, it is a principal object of the invention to provide a pet door kit with one-way and two-way passage features.

It is another object of the invention to provide a pet door kit for a screened door or window.

It is a further object of the invention to provide a swinging pet door kit for a screened door or window including top pivot pins, slide closures, eared swivel closures, and magnet closures.

Still another object of the invention is to provide a pet door kit including a spline roller, a length of spline, a razor blade, a crossbar, a roll of fluorescent tape, and installation instructions.

Yet another object of the invention is to provide a pet door kit including a ramp.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention provides a pet door installation kit for do-it-yourself people having pets for permitting access in and out of the home through either a screened door or window.

Figure 1:
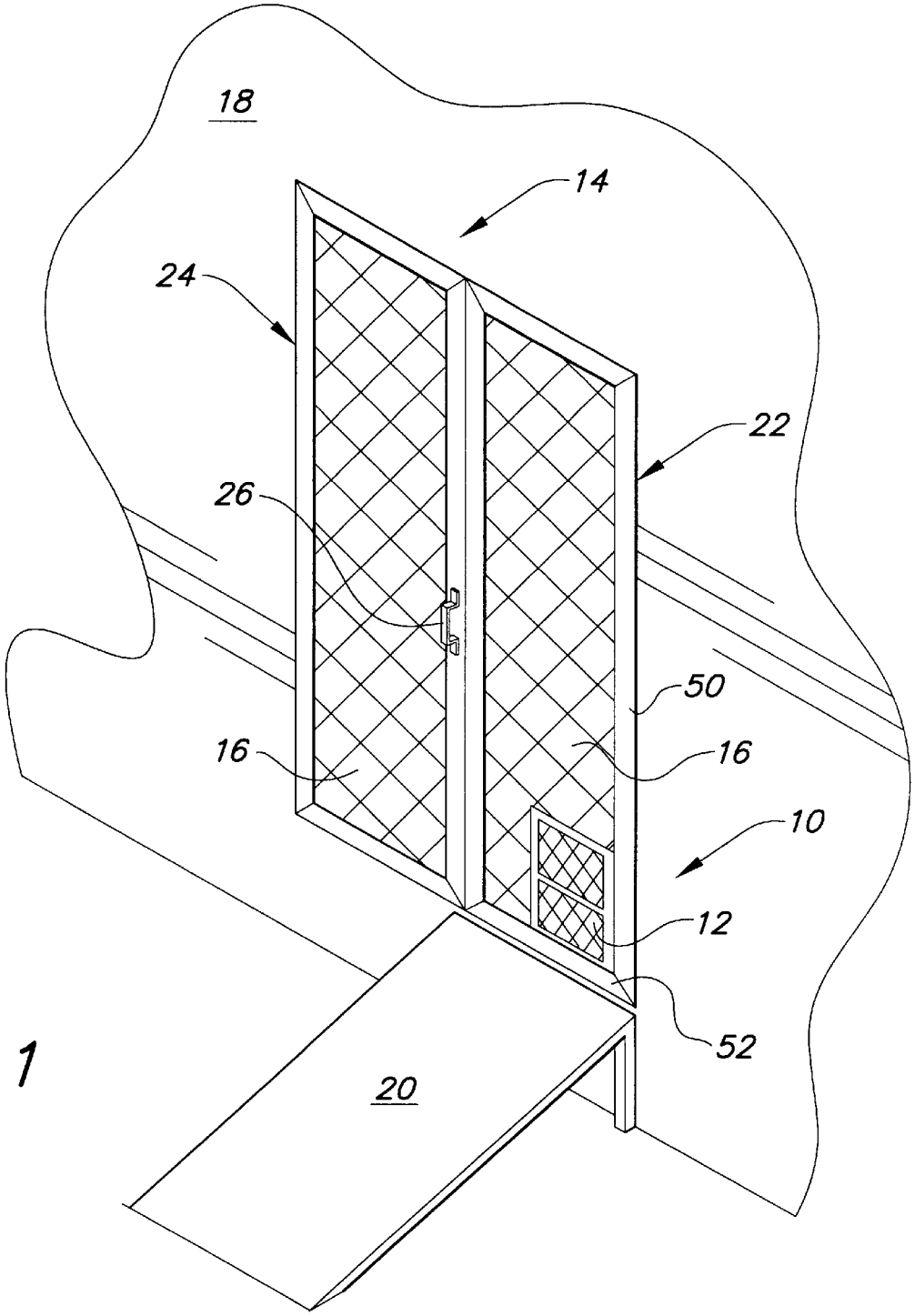
FIG. 1 is an environmental, perspective view of a two-way pet screen door and ramp according to the present invention.

FIG. 1 illustrates a pet screen door 10 with screen 12 installed in a corner of an elevated two-part host screen door 14 having a host screen 16. If the host door 14 is elevated in the house 18, a ramp 20 is provided. The door 14 can comprise a right door portion 22 and a left door portion 24 which can either open inward by handle 26 or slide open.

Figure 2:
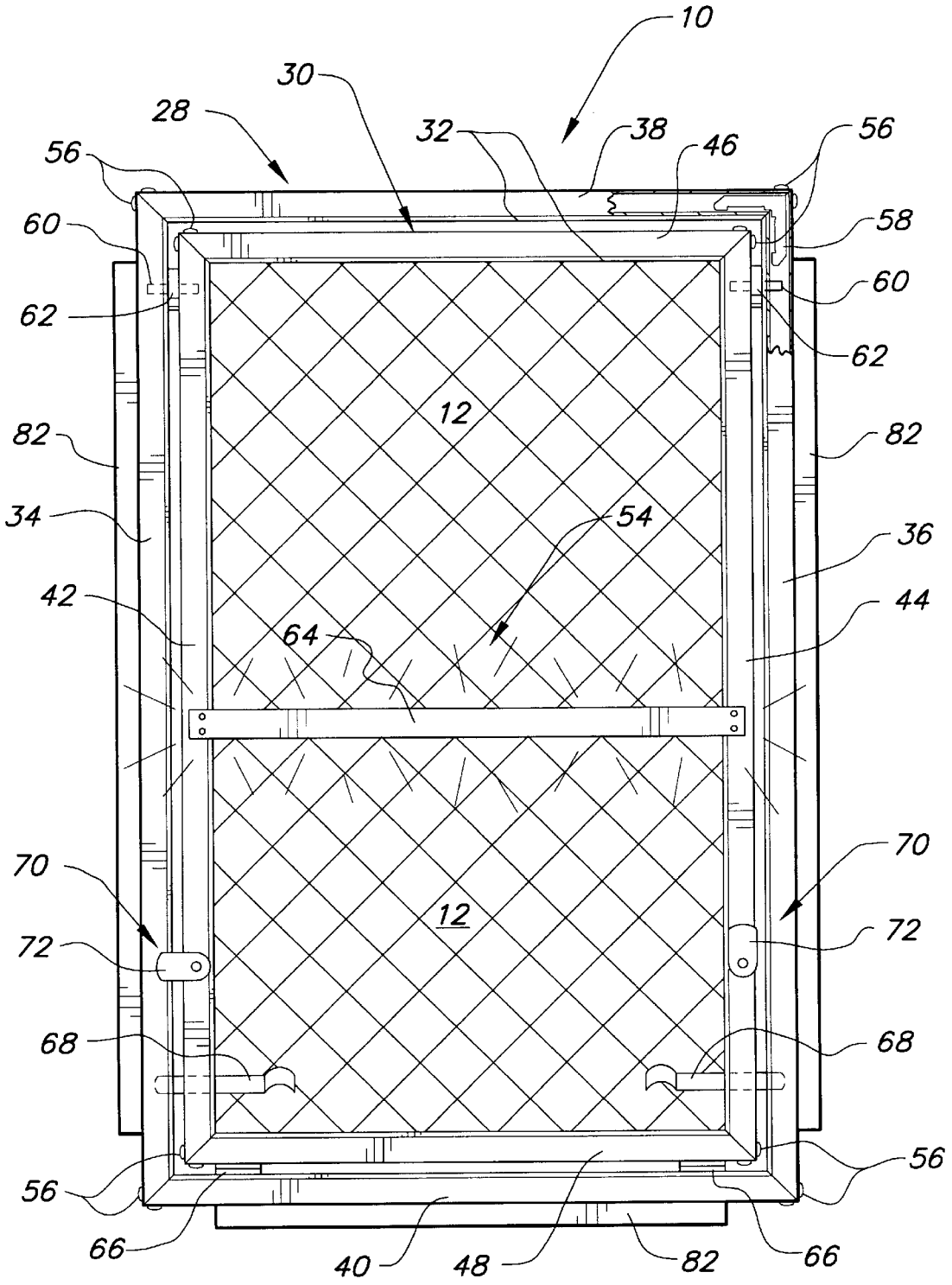
FIG. 2 is a front view of a pet door showing pivoting door hinges, sliding door closures, swiveling door closures, magnetic closures, door hinges, side bar attachments, and a breakaway corner.

FIG. 2 shows the pet screen door 10 with its attachment means to the host screen door 14, various closure devices available for directional passage through the pet screen door 10, and a corner breakaway portion. The pet screen door 10 is prefabricated to the customer's size preference, but a standard size of 12 in. wide and 18 in. in height is contemplated for cats and small dogs. The rectangular metal frame, preferably aluminum, consists of an outer frame 28 and an inner frame 30. The inner edges of frames 28 and 30 have grooves 32 for insertion of the edges of the screens 16 and 12, respectively.

The outer frame 28 consists of a left stile 34, a right stile 36, a top rail 38, and a bottom rail 40 as viewed from outside the dwelling. Similarly, the inner frame 30 consists of a left stile 42, a right stile 44, a top rail 46, and a bottom rail 48. The right door portion 22 of the host screen door 14 in FIG. 1 has a right stile 50 and a bottom rail 52 providing a corner for the pet screen door 10. In order to secure the pet door 10 in the corner, a pair of flat side bars 82 with an adhesive backing are attached on the inside joining the pet door 10 to the host screen door 14.

A fluorescent tape covered horizontal crossbar 54 on the pet screen door 10 provides a target for the pet in darkness and strengthens the rigidity of the pet screen door 10 and its screen 12.

FIG. 2 further shows the fasteners 56 such as aluminum pop rivets or screws for securing the corners of the outer and inner frames 28 and 30, respectively. However, for greater structural integrity of the corners, a right-angled metal piece 58 is inserted as depicted in the breakaway portion. A pair of pivotal pins 60 with shoulders or spacers 62 are provided proximate the top portions of the stiles 34, 36, 42, and 44 for free swinging of the inner frame 30 of the pet screen door 10.

A fluorescent tape 64 covered crossbar 54 is fastened with fasteners 56 to the outside surfaces of the pet door stiles 42 and 44 of the inner frame 30 of the pet door 10 at their midpoints. The pet now has the advantage of seeing the door at night, and the inner frame 18 of the pet door 10 is reinforced to resist damage to the fiberglass mesh screen 44. It is optional to secure the crossbar on either the inside or outside surface of the pet door 10, and, alternatively, to even add another crossbar 54 on an opposite side with its fluorescent tape.

In order to maintain the pet screen door 10 from oscillating with breezes, a pair of bar magnets or magnetic latches 66 with adhesive backing are attached to opposite faces of the bottom rails 26 and 38 proximate each corner.

For restricting the movement of the pet to either stay inside or outside, a pair of sliding lock means 68 is installed on either the inside or outside of the pet door 10 to penetrate both stiles of the outer and inner frames 28 and 30, respectively, from the screen 12 side. The sliding lock 68 consists of a metal strip with a curvilinear finger pull 70. The curved end portion is designed to curve towards the screen 12 in order to minimize any irritation to the pet using the pet door 10.

For controlling pet passage through the pet door 10, a one-way and a two-way control system has been devised as further depicted in FIG. 2. A pair of swiveling lock means 70 having elliptically shaped ears 72 on each end of a secured pivot pin 74 is positioned above the sliding locks 68 on the stiles 42 and 44 of the inner frame 30. The lock means 70 can independently maintain a closed or open door condition. Therefore, if the pet owner decides to permit only a one-way exit condition, the owner will place the pair of outside ears 72 in a locking position. If the pet owner decides to permit only a one-way entrance condition, the owner will place the pair of inside ears 72 only in a locking position.

Figure 3:
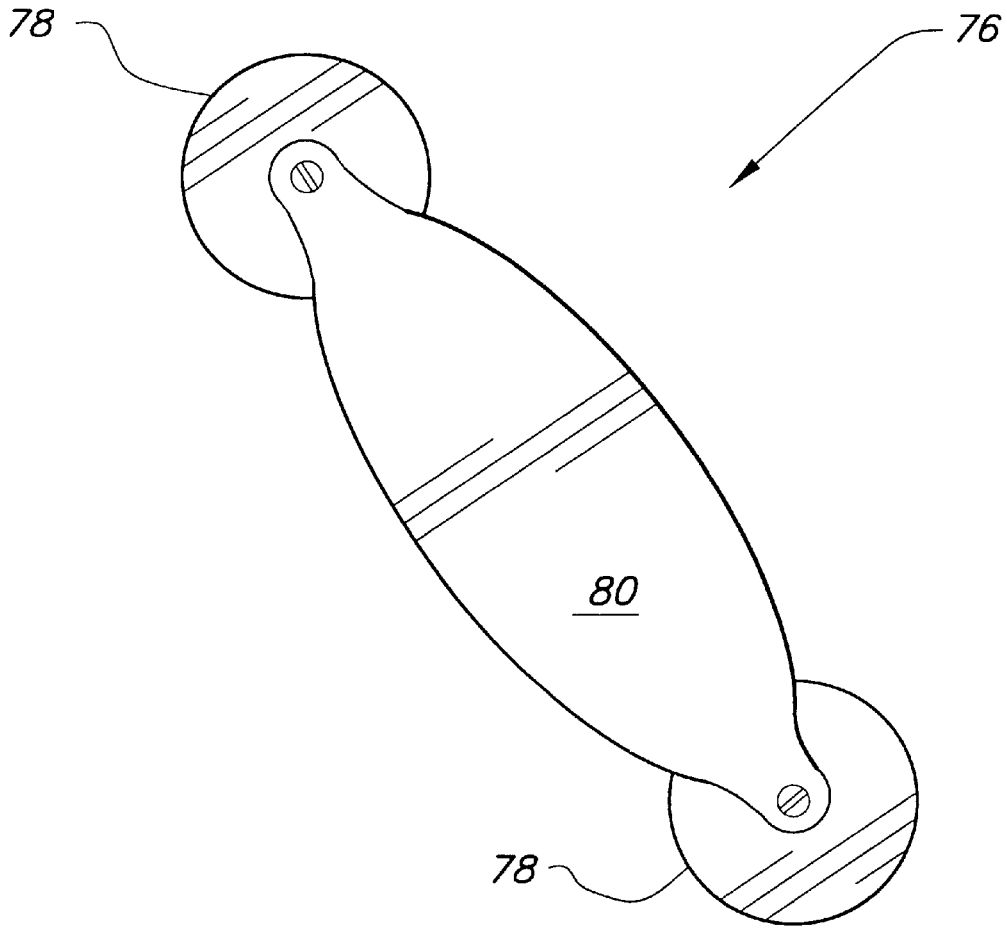
FIG. 3 is a spline roller device utilized to attach the screen edge to the pet door.

FIG. 3 is a side elevational view of the roller device 76 supplied with the kit along with instructions, a single edged razor blade, a length of spline, one or two crossbars 54, and fluorescent tape covering the crossbar 54. The roller device 76 consists of Teflon roller discs 78 having thin concave and convex edges, respectively, at the ends of the metal handle 80 for anchoring the cut edges of the host screen 16 and the spline into the outer frame 28 of the pet door 10.

Thus, the homeowner can specify a certain size pet screen door which will be fabricated at the factory and with the kit materials mailed to the homeowner for installation. The installation process requires that the host screen 16 of the host screen door 12 at its lower corner be cut with the razor included in the kit, and the pet screen door 10 combined with the outer frame 16 of the pet screen door 10 by inserting the spline with the roller device 72. A bead of caulk can then be applied over the spline for proper sealing. Any excess screen material exposed can be trimmed with the razor.

It is to be understood that the present invention is not limited to the embodiments described above, but encompasses any and all embodiments within the scope of the following claims.

We claim:

1. A one- and two-way screen door kit comprising:

a pet screen door for a screen door or screen window comprising:

an inner rectangular frame having a top rail and a bottom rail connected by a pair of stiles, and containing a mesh screen;

an outer rectangular frame containing an outer groove circumscribing said inner rectangular frame with a minimal gap and having a top rail and a bottom rail connected by a pair of stiles;

said inner rectangular frame having a pair of hinge pins secured at proximate its top edge and pivoting in the outer rectangular frame;

a pair of sliding lock means positioned on the stiles of the inner frame proximate to the bottom to prevent passage by passing into the stiles of the outer frame;

a pair of swiveling lock means with each pair having independently movable ears positioned on both inside and outside portions of the stiles of the inner frame to prevent one-way passage; and an installation kit containing a spline roller, a length of spline, a single edged razor blade, fasteners, and instructions.

2. The pet screen door kit according to claim 1, including at least one horizontal crossbar traversing the inner rectangular frame at a midpoint.

3. The pet screen door kit according to claim 2, wherein said installation kit contains a roll of fluorescent tape for covering said at least one horizontal crossbar.

4. The pet screen door kit according to claim 1, wherein said mesh screen is fiberglass.

5. The pet screen door kit according to claim 1, wherein each of said pair of sliding lock means is a bar with a finger pull end having a curved end portion.

6. The pet screen door kit according to claim 1, wherein said ears of said pair of swiveling lock means are structured to pivot independently on a cross pin.

7. The pet screen door kit according to claim 1, wherein corners of the outer and inner frames are reinforced with right-angled inserts and pop rivets.

8. The pet screen door kit according to claim 1, wherein said spline roller has rollers at each end, wherein one roller edge is concave and the other roller edge is convex.

9. The pet screen door kit according to claim 1, including a pair of flat elongated side bars with adhesive backing for securing the pet door to a corner of the host screen door.

10. The pet screen door kit according to claim 1, including a pair of magnets proximate each lower corner of the pet screen door for preventing free swinging of the pet screen door.

11. The pet screen door kit according to claim 1, including a pet ramp for elevated screen doors to accommodate diminutive pets.

* * * * *